US005205761A

United States Patent [19]

Nilsson

[11] Patent Number: 5,205,761

[45] Date of Patent: Apr. 27, 1993

[54] SHIELDED CONNECTOR ASSEMBLY FOR COAXIAL CABLES

[75] Inventor: Uno Nilsson, Saltsjö-Boo, Sweden

[73] Assignee: Molex Incorporated, Lisle, Ill.

[21] Appl. No.: 899,398

[22] Filed: Jun. 15, 1992

[30] Foreign Application Priority Data

Aug. 16, 1991 [SE] Sweden ..... 9102375-4

[51] Int. Cl.[5] ..... H01R 13/00

[52] U.S. Cl. ..... 439/578; 439/394

[58] Field of Search ..... 439/394, 578-585, 439/607-610

[56] References Cited

U.S. PATENT DOCUMENTS

| | | | |
|---|---|---|---|
| 2,706,282 | 4/1955 | Dudra | 339/119 |
| 4,062,615 | 12/1977 | Navarro | 339/98 |
| 4,261,632 | 4/1981 | Narozny | 339/97 |
| 4,444,454 | 4/1984 | Horowitz | 439/394 |
| 4,701,001 | 10/1987 | Verhoeven | 439/394 |
| 4,701,137 | 10/1987 | DeRoss | 439/394 |
| 4,744,774 | 5/1988 | Pauza | 439/578 |
| 4,744,775 | 5/1987 | Pauza | 439/92 |
| 5,044,978 | 9/1991 | Gelin | 439/579 |
| 5,083,934 | 1/1992 | Kawaguichi | 439/582 |
| 5,098,314 | 3/1992 | Castagna et al. | 439/579 |

FOREIGN PATENT DOCUMENTS 2103434 5/1982 United Kingdom .

*Primary Examiner*—Joseph H. McGlynn
*Attorney, Agent, or Firm*—A. A. Tirva

[57] ABSTRACT

A shielded connector assembly is provided for a coaxial cable which includes a center conductor with an insulating layer thereabout, a conductive shield and an outer insulating covering. A non-conductive body is provided for receiving an end of the coaxial cable with the conductive shield exposed. The body has a conductive contact thereon for engaging the center conductor of the cable. A conductive outer casing is positioned about at least a portion of the body for shielding the cable end and having a portion for engaging the outside of the conductive shield of the cable. A rigid sheath is positioned between the insulating layer and the conductive shield of the cable to provide backing support for the shield on the inside thereof. The portion of the conductive outer casing which engages the outside of the conductive shield of the cable projects through a slit in the body. Preferably, the body includes a single lower body part and a pair of upper body parts. The conductive outer casing includes a single lower casing half and an upper casing half defined by two casing parts. The connector assembly thereby can interconnect the ends of two coaxial cables and facilitate some assembly being performed in a production environment and the remaining assembly being performed in the field.

22 Claims, 4 Drawing Sheets

SHIELDED CONNECTOR ASSEMBLY FOR COAXIAL CABLES

FIELD OF THE INVENTION

This invention generally relates to the art of connector assemblies and, particularly, to a connector assembly for interconnecting coaxial cables.

BACKGROUND OF THE INVENTION

In interconnecting coaxial cables, it is important to achieve excellent contact between the center conductors of the coaxial cables on the one hand, and grounding the shields of the coaxial cables on the other hand. This is particularly true in telephone, radio and television applications wherein the coaxial cables transfer signals having high frequencies. Such interconnections often occur where the signals are subject to interference, and it is important to insure that any interference that occurs on the shield is conducted to ground. Examples of such coaxial cable connectors are shown in U.S. Pat. Nos. 4,701,001; 4,744,775 and 4,701,137.

Other factors in designing such connector assemblies include substantial savings that can be achieved if part of the interconnecting work is carried out in a production environment and the remaining part of the work is carried out in the field.

This invention is directed to providing a new and improved connector assembly of the character described for interconnecting coaxial cables.

SUMMARY OF THE INVENTION

An object, therefore, of the invention is to provide a new shielded connector assembly for interconnecting a coaxial cable with another coaxial cable or a complementary electronic component.

The connector assembly is adapted for use with a coaxial cable which includes a center conductor with an insulating layer thereabout, a conductive shield and an outer insulating covering.

Generally, the shielded connector assembly of the invention includes a non-conductive body for receiving an end of the coaxial cable with a portion of the conductive shield thereof exposed. The body has conductive contact means thereon for engaging the center conductor of the cable. A conductive outer casing means is disposed about at least a portion of the body for shielding the cable end and having a portion for engaging the outside of the conductive shield of the cable. A feature of the invention includes insert means positioned between the insulating layer and the conductive shield of the cable to provide backing support for the shield on the inside thereof as said portion of the conductive outer casing engages the outside of the shield. Generally, the insert means is resilient in a transverse direction.

In the preferred embodiment of the invention, the insert means which is sandwiched between the insulating layer and the conductive shield of the cable is provided in the form of a tubular sheath of metal material which is generally rigid but which includes a slit lengthwise thereof to provide radial resiliency therefor. The conductive outer casing means is provided in the form of a pair of outer casing halves clamped onto the body and having portions engaging the conductive shield of the cable substantially circumferentially thereabout.

The resilient metal sheath facilitates achieving excellent contact between the shield of the cable and the outer conductive casing of the connector assembly which shields the cable end.

On the other hand, the shielded connector assembly of the invention provides a unique system for securing the cable within the non-conductive body and providing access to the shield of the cable by the outer conductive casing means.

More particularly, the non-conductive body forms a housing means for receiving the end of the coaxial cable with the conductive shield exposed. The housing means is profiled to substantially surround the cable end by means of a pair of mateable non-conductive body halves. The body includes slit means in transverse alignment with the exposed conductive shield of the cable end. The conductive outer casing means include a portion projecting through the slit means in the housing means into engagement with the conductive shield of the cable end.

As indicated above, it is advantageous to perform part of the interconnecting work in a production environment and the remaining work in the field. To this end, the invention contemplates that the shielded connector assembly be provided for interconnecting the ends of two coaxial cables. A first non-conductive body has conductive contact means thereon for engaging and interconnecting the center conductors of the cables. A pair of second non-conductive bodies are mateable with the first non-conductive body to define a housing means forming a channel for receiving the ends of the coaxial cables in an in-line relationship and with the conductive shields thereof exposed. Each of the bodies has slit means in transverse alignment with the exposed conductive shields of the cables. The outer conductive casing means includes a pair of casings each having a portion projecting through the slit means into engagement with a respective one of the conductive shields of the cable ends. Therefore, one of the coaxial cables can be interconnected in the connector assembly in a production environment, for instance, with the remainder of the interconnection being carried out in the field.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
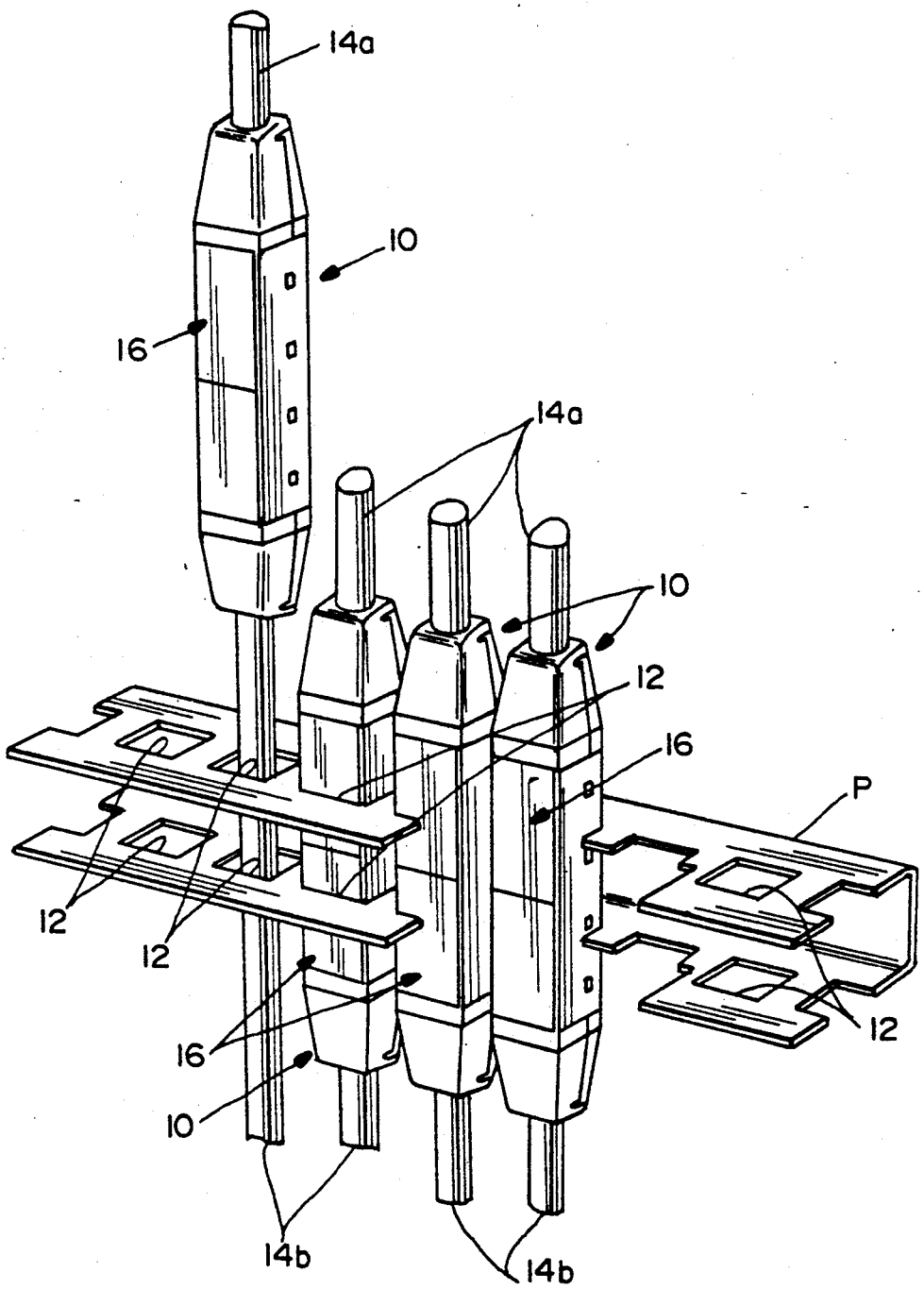
FIG. 1 is an illustration of four connector assemblies of the invention in conjunction with a grounded metal plane, with three of the connectors positioned in the plane and the fourth connector about to be so positioned.

Referring to the drawings in greater detail, and first to FIG. 1, four shielded connector assemblies, generally designated 10, are shown in conjunction with a ground plane "P" which includes a plurality of apertures 12 within which connector assemblies 10 are positionable. Three of the connector assemblies are shown positioned or mounted in the ground plane, with one (the left-hand) connector assembly being shown about to be mounted in the ground plane. Each connector assembly is adapted for interconnecting or splicing a pair of coaxial cables, generally designated 14*a* and 14*b*. Each connector assembly includes conductive outer casing means, generally designated 16, which engage ground plane "P" within pairs of apertures 12. The outer conductive casings engage the shield portions of the coaxial cables, as described hereinafter.

Figure 2:
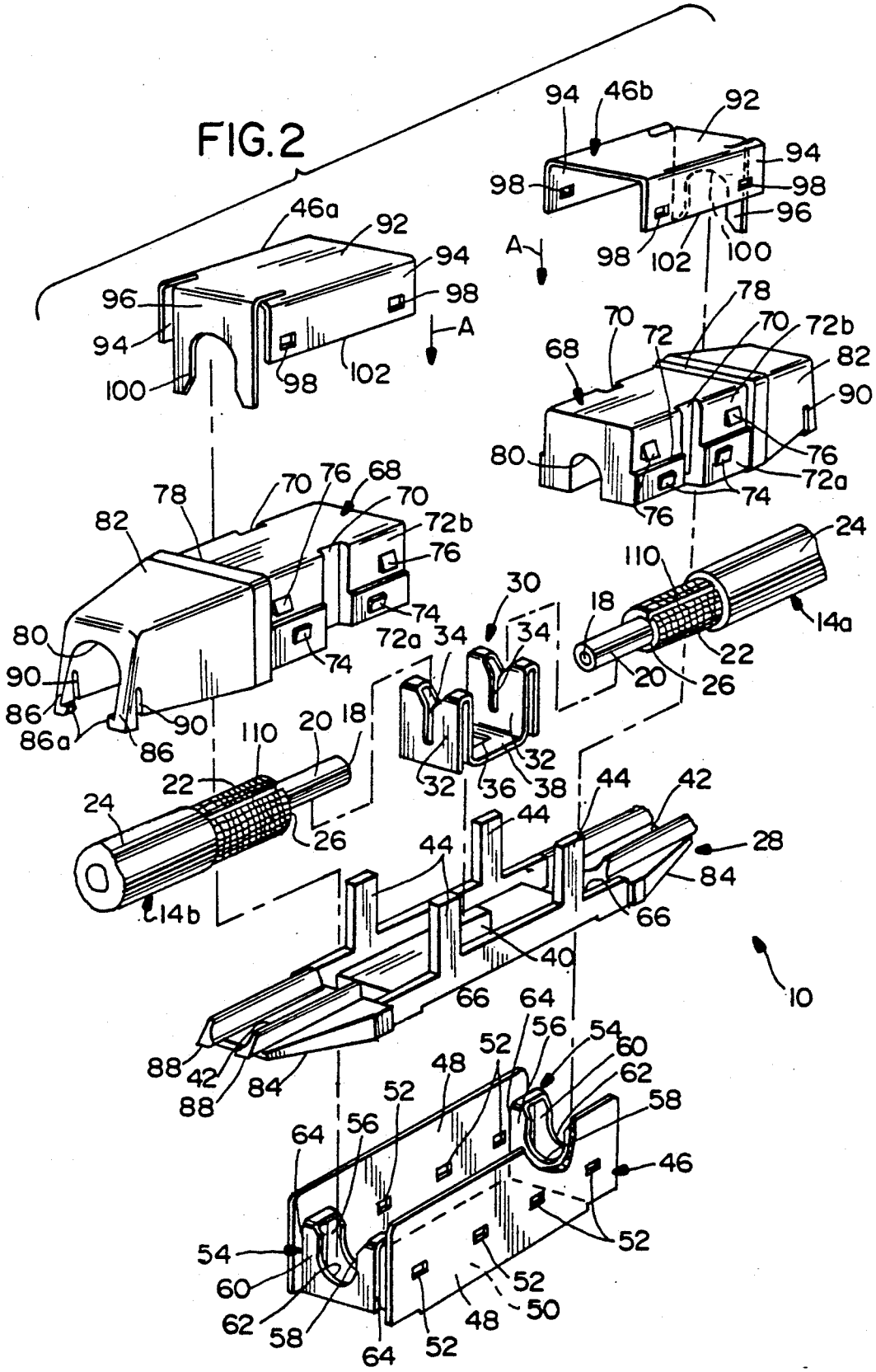
FIG. 2 is an exploded perspective view of one of the shielded connector assemblies of the invention.

Referring to FIG. 2, one of the shielded connector assemblies 10 is shown in an exploded depiction to facilitate an illustration of the various components thereof. Coaxial cables 14*a* are shown in an in-line relationship as they are to be interconnected within the connector. Each coaxial cable 14*a*, 14*b* includes a center conductor 18 with an insulating layer 20 thereabout, along with a conductive shield 22 about the insulating layer and an outer insulating covering or jacket 24. As will be described in greater detail, a backing sheath 26 is sandwiched between insulating layer 20 and conductive shield 22.

Generally, connector assembly 10, as shown in FIG. 2, includes housing means provided by a first or lower elongated body half, generally designated 28, and a bifurcated or slit contact, generally designated 30. The bifurcated contact is fabricated of conductive material, such as being stamped and formed of metal. The contact includes two end walls 32, each of which is slit, as at 34, to provide insulation displacement engagement with conductive cores 18 of the coaxial cables as the metal of end walls 32 pierce insulating layers 20 of the cables. Contact 30 has a rectangular aperture 36 in a base portion 38 thereof for press fitting over a boss 40 on the inside of first body 28. The body also has a pair of troughs 42 at opposite ends thereof within which coaxial cables 14*a* and 14*b* are positionable. Lastly, first body 28 has four upstanding guide arms 44 for purposes described hereinafter.

Shielded connector assembly 10 also includes conductive outer casing means which is provided by a lower elongated outer casing half, generally designated 46, and a two-part upper casing half including casing parts, generally designated 46*a* and 46*b*, the upper casing parts being described in greater detail hereinafter. Lower casing half 46 and upper casing parts 46*a*, 46*b* are fabricated as stamped and formed components of conductive metal.

More particularly, lower casing half 46 is generally U-shaped in cross-section and includes a pair of side walls 48 and a bottom wall 50. Four apertures 52 are formed in each side wall 48 in a horizontal line. The ends of bottom wall 50 are up-turned to form generally inverted U-shaped receptacles, generally designated 54, defining saddles for receiving engaging the shields of coaxial cables 14*a* and 14*b*. Each receptacle 54 has an inner wall 56 defining an arcuate recess 58 and an outer wall 60 defining an arcuate recess 62. With walls 56 being integral with bottom wall 50, recess 58 is vertically rigid. However, with wall 60 extending generally freely of the receptacle, recess 62 can yield for flexible clamping purposes. It can be seen that receptacles 54 are spaced inwardly of side walls 48, as at 64. The receptacles are sized for fitting into openings 66 of lower body 28.

From the foregoing description of lower body 28, contact 30 and lower casing half 46, it can be understood that these three components advantageously can be factory-assembled to produce a lower section of the connector assembly. It also should be noted that these components span the splice area between the ends of the cables.

The housing means of the connector assembly further is provided with an upper body half defined by a pair of identical upper body parts, generally designated 68. The body parts are oppositely oriented as shown in FIG. 2. Each body part includes a pair of vertically oriented guide grooves 70, one groove on each side of each body part for respectively receiving guide arms 44 of lower body half 28. The sides of each upper body part 68 are stepped or offset, as at 72, to provide a lower side section 72*a* which is disposed transversely outwardly slightly from a recessed side section 72*b*, for purposes described in greater detail hereinafter. Each body part also has a pair of outwardly projecting detents 74 on side section 72*a* and a pair of outwardly projecting detents 76 on inwardly recessed side section 72. Each upper body part also includes a vertically extending through opening 78, and a horizontal through channel 80. The body parts are tapered, as at 82, toward their outer distal ends for facilitating insertion of the connector assembly into apertures 12 of ground plane "P" (FIG. 1). For similar purposes, lower body half 28 is tapered at its distal ends, as at 84. Lastly, the extreme distal ends of each upper body part 68 include a pair of latch arms 86 having hook portions 86*a* for snapping under shoulders 88 of lower body half 28. The arms are made resilient by slits 90 in the body parts, which, along with lower body half 28, are fabricated of dielectric material such as integrally molding the components of plastic or the like.

Still referring to FIG. 2, the conductive outer casing means of the connector assembly include the upper casing half defined by the two casing parts 46*a* and 46*b*. The two upper casing parts are identical but oppositely oriented, as shown. Each casing part includes an upper wall 92, a pair of side walls 94 and an end flange 96. Each side wall 94 is provided with a pair of apertures 98. Each end flange 96 is provided with an arcuate recess 100 facing downwardly toward upwardly opening recesses 58, 62 of receptacles 54 in lower casing half 46.

In assembly, coaxial cables 14*a* and 14*b* are inserted into through channels 80 in upper body parts 68 to a position whereby conductive shields 22 at least are in alignment with vertical through openings 78. Either before or after insertion of the coaxial cables, upper outer casing parts 46*a* and 46*b* are moved downwardly in the direction of arrows "A" whereby end flanges 96 pass into through openings 78. The casing parts are assembled to a position whereat lower edges 102 engage offset areas 72 of upper body parts 68, and detents 76 of the upper body parts snap into apertures 98 of the upper casing parts. One or both of the subassemblies of one coaxial cable, one upper body part and one upper casing part then are lowered onto the subassembly of lower casing half 46, lower body 28 and contact 30. Slits 34 in the contact pierce insulating layers 20 of the coaxial cables to establish conductivity with center cores 18. The subassemblies are moved or mated with the lower subassembly until outwardly projecting detents 74 of upper body parts 68 snap into apertures 52 in lower casing half 46.

As stated above, the shielded connector assembly 10 of the invention is readily applicable for carrying out some assembly work in a production environment and other assembly work in the field, for substantial cost savings. For instance, in mounting in the field as at a telephone exchange, wherein the actual interconnection of the coaxial cables often is carried out, the components cooperating with one of the coaxial cables, such as coaxial cable 14*a*, can be carried out as described above. In other words, with the upper body half of the housing means of the connector being in two parts 68, and the upper casing half of the conductive outer casing means of the connector being provided by two upper casing parts 46*a* and 46*b*, one of the coaxial cables can be interconnected in the connector assembly in a production environment and the other coaxial cable interconnected in the connector assembly in the field. As an example, referring to FIG. 1, lower body part 28, contact 30, lower casing half 46, coaxial cable 14*b*, the left-hand (as viewed in FIG. 2) upper body part 68 and the left-hand upper casing part 46*a* all can be partially inserted into one of the apertures in the pair 12 thereof in ground plane "P". The other coaxial cable 14*a* and the right-hand upper body part 68 and casing part 46*b* then can be assembled in the field and the connector assembly can be fully inserted into the ground plane.

Figure 3:
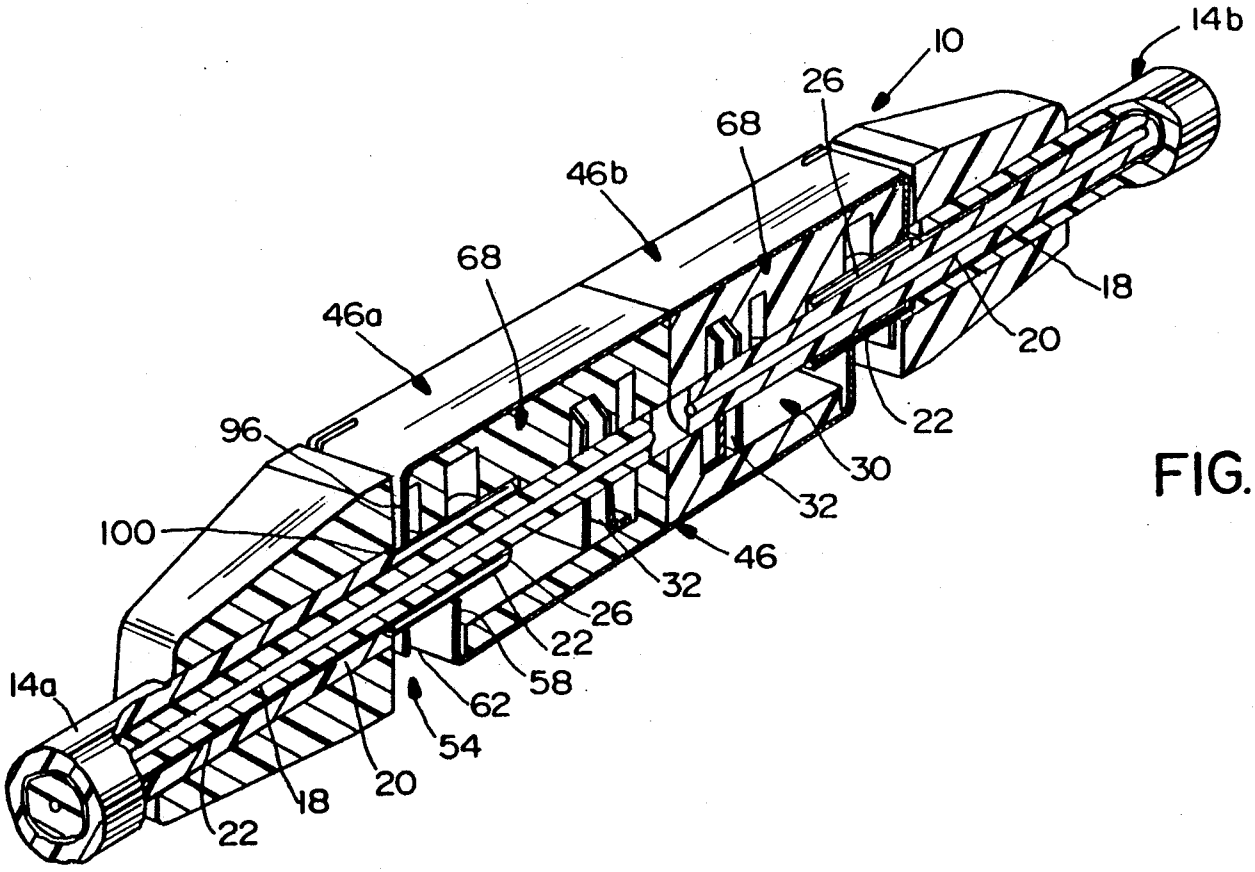
FIG. 3 is an axial section through the connector assembly of the invention in assembled condition.

FIG. 3 shows the entire shielded connector assembly 10 of the invention in fully assembled condition. It clearly can be seen in this view where metal tubular sheaths 26 are sandwiched between insulating layers 20 and conductive shields 22 of coaxial cables 14*a* and 14*b*. The sheaths can be seen disposed inside of the conductive shields substantially thereabout to provide inside backing therefor. Recesses 100 in the end flanges 96 of upper casing parts 46*a*, 46*b* can be seen engaging the top of the conductive shields, and recesses 58 and 62 of receptacles 54 engaging the bottom of the conductive shields. When these components engage the shields, the tubular sheaths provide a backing whereby extremely good contact is achieved between the shields and the conductive outer casing means of the connector assembly which provides overall shielding for the coaxial cable ends. FIG. 3 also shows how contact 30 pierces the insulating layers 20 of the coaxial cables to engage center conductors 18 to interconnect or splice the cables.

Figure 4:
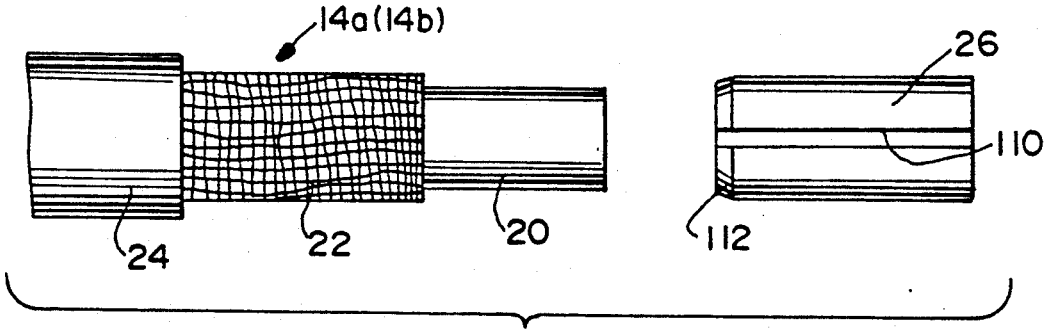
FIG. 4 is an elevational view of an end of a coaxial cable, stripped to expose the shield thereof, and in conjunction with the tubular sheath insert of the invention.
Figure 5:
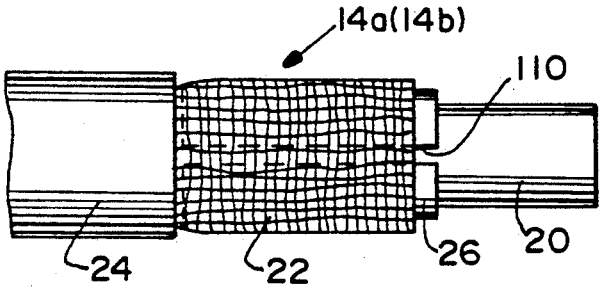
FIG. 5 is a view similar to that of FIG. 4, with the tubular sheath insert inserted between the insulating layer and the conductive shield of the cable.
Figure 6:
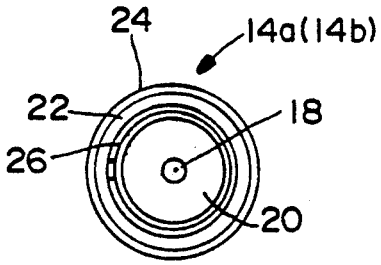
FIG. 6 is a vertical section taken generally along line 6—6 of FIG. 5.

FIGS. 4–6 show in considerable detail the components of a coaxial cable 14*a* or 14*b* in conjunction with one of the tubular metal sheaths 26. It can be seen that the tubular sheath is slit, as at 110. Therefore, while the sheath is fabricated of rigid metal material, the slit provides resiliency in a radial direction to permit clamping and a good connection with the respective components of the conductive outer casing means of the connector assembly. In addition, one end 112 of the sheath is chamfered to facilitate insertion of the sheath between insulating layer 20 and conductive shield 22 of the coaxial cable, as illustrated in FIG. 5. FIG. 6 shows the respective inner positioning of the sheath relative to the radial disposition of the components of the cable. In essence, FIGS. 4–6 illustrate that the sheath provides a form of axial insert means between the insulating layer and the conductive shield of the cable.

Figure 7:
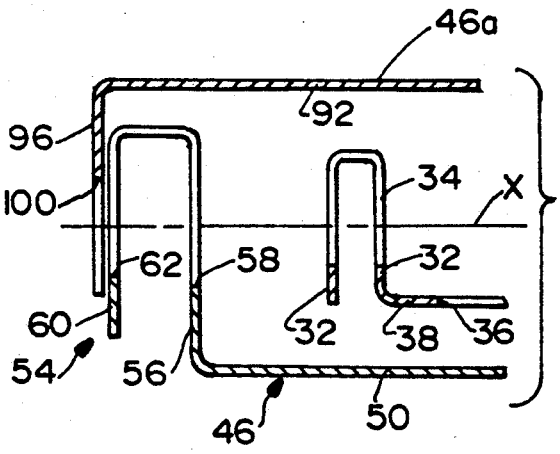
FIG. 7 is an axial section, on an enlarged scale, showing adjacent ends of the outer casing portions and contact portions which engage the components of the coaxial cable, isolated from the other components of the connector assembly.
Figure 8:
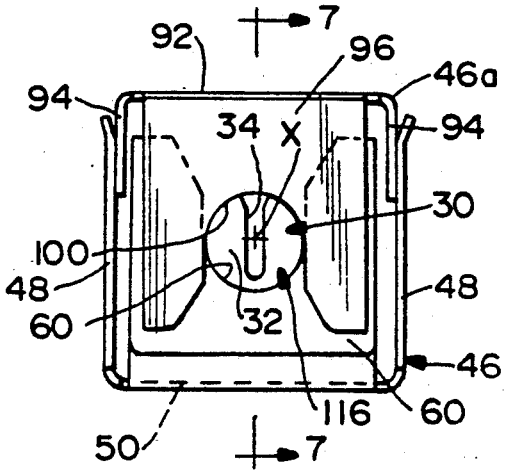
FIG. 8 is an end elevational view looking toward the left-hand end of FIG. 7.

FIGS. 7 and 8 show in greater detail the position of one of the receptacles 54 of lower casing half 46 and end flange 96 of one of the upper casing halves 46*a* of the conductive outer casing means of the connector assembly, when those components are in assembled condition for clamping the shield of one of the coaxial cables. In addition, these figures show the positioning of one of the slits 34 in contact 30 for piercing insulating layer 20 of the coaxial cable to engage the conductor thereof. The positions of these components are exemplified in relation to a general longitudinal central axis "X" of the connector assembly. It can be seen particularly in FIG. 8 how the slit in the contact is aligned with the center of a generally circular area, generally designated 116, through which the coaxial cable extends.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A shielded connector assembly for a coaxial cable which includes a center conductor with an insulating layer thereabout, a conductive shield and an outer insulating covering, comprising:

a non-conductive body for receiving an end of the coaxial cable with the conductive shield thereof exposed, the body having conductive contact means thereon for engaging the center conductor of the cable;

conductive outer casing means about at least a portion of the body for shielding the cable end and having a portion for engaging the outside of the conductive shield of the cable; and insert means positioned between the insulating layer and the conductive shield of the cable to provide backing support for the shield on the inside thereof wherein said insert means is generally rigid and is resilient in a transverse direction, with the transverse resiliency therefor being provided by a longitudinal slit.

2. The shielded connector assembly of claim 1 wherein said insert means comprise a tubular sheath sandwiched between the insulating layer and the conductive shield of the cable, the tubular sheath being fabricated of generally rigid material being slit lengthwise thereof to provide radial resiliency therefor.

3. The shielded connector assembly of claim 2 where said portion of the conductive outer casing means engages the conductive shield of the cable substantially circumferentially thereabout.

4. The shielded connector assembly of claim 3 wherein said conductive outer casing means comprise a pair of outer casing halves clamped onto the body.

5. A shielded connector assembly for interconnecting the ends of two coaxial cables each having a center conductor with an insulating layer thereabout, a conductive shield and an insulating covering, comprising:

a first non-conductive body having conductive contact means thereon for engaging and interconnecting the center conductors of the cables;

at least one second non-conductive body mateable with the first non-conductive body to define a housing means forming a channel for receiving the ends of the coaxial cables in an in-line relationship and with the conductive shields thereof exposed, slit means in said housing means in transverse alignment with the exposed conductive shields of the cable ends; and conductive outer casing means disposed about at least a portion of said housing means for shielding the cable ends and having portions projecting through said slit means into engagement with the conductive shields of the cable ends.

6. The shielded connector assembly of claim 5 wherein said first and second bodies are constructed to define the housing such that the housing substantially surrounds the cable ends except for said slit means.

7. The shielded connector assembly of claim 5 including a pair of said second non-conductive bodies mateable with the first non-conductive body about the respective ends of the coaxial cables.

8. A shielded connector assembly for a coaxial cable which includes a center conductor with an insulating layer thereabout, a conductive shield about the insulating layer and an outer insulating covering, comprising:

a non-conductive housing means for receiving an end of the coaxial cable with the conductive shield exposed, the housing means having slit means in transverse alignment with the exposed conductive shield of the cable end; and conductive outer casing means disposed about at least a portion of the housing means for shielding the cable end and having a portion projecting through said slit means in the housing means into engagement with the conductive shield of the cable end.

9. The shielded connector assembly of claim 8 wherein said housing means include a first non-conductive body having contact means thereon for engaging the center conductor of the cable.

10. The shielded connector assembly of claim 9 wherein said housing means include a second non-conductive body mateable with the first non-conductive body to form a channel for receiving the end of the cable.

11. The shielded connector assembly of claim 10 wherein said first and second non-conductive bodies substantially surround the cable end when the bodies are mated.

12. A shielded connector assembly for interconnecting two coaxial cables each having a central conductor with an insulating layer thereabout, a conductive shield and an insulating covering, comprising an elongate conductive first outer casing having two end portions each with two recesses bounded by walls, a first non-conductive body positioned in said first outer casing and through which said end portions extend, a conductive slit contact disposed in said first body and having two end walls provided with slits, a second and a third non-conductive body each disposed over one of said contact end walls and each disposed over a respective longitudinal half of the first body as well as each within a respective longitudinal half of said first outer casing, each second and third body being provided with a slit, and a second and a third conductive outer casing adapted to be disposed on said second and third bodies, respectively, and each second and third conductive outer casing being provided with an end portion having a recess bounded by walls and being adapted to be introduced through the last-mentioned slit.

13. A connector in accordance with claim 12 wherein walls of the slits of said slit contact are adapted to resiliently make contact with the central conductor each at an end of the respective coaxial cables to be interconnected.

14. A connector in accordance with claim 12 wherein said first body is provided with guide for cooperating with guide grooves in the second and third bodies.

15. A connector in accordance with claim 12 wherein said first outer casing is provided with apertures mating with latching projections in the second and third bodies.

16. A connector in accordance with claim 15 wherein the second and third bodies are provided with latching projections mating with apertures in the second and third outer casings.

17. A connector in accordance with claim 12 wherein the walls of the recesses in the ends of said first outer casing are adapted to make contact with the shield each at an end of a respective coaxial cable of the two coaxial cables to be interconnected.

18. A connector in accordance with claim 17 wherein the walls of the recesses in the ends of the second and third outer casings are adapted to make contact with the respective shields each at one end of the coaxial cables to be interconnected.

19. A connector in accordance with claim 17 wherein a conductive sheath is positioned under the shield at a respective end of each of the coaxial cables to be interconnected.

20. A connector in accordance with claim 19 wherein the walls of the recesses in the ends of the second and third outer casings are adapted to make resilient contact with the shields under which said conductive sheaths are positioned each at one end of the respective coaxial cables to be interconnected.

21. A connector in accordance with claim 20 wherein said conductive sheaths are transversely resilient.

22. A connector in accordance with claim 21 wherein said conductive sheaths are provided with slits.

* * * * *